US006003348A

United States Patent [19]

McCrea

[11] Patent Number: 6,003,348

[45] Date of Patent: Dec. 21, 1999

[54] ADJUSTABLE CABLE LOCK

[76] Inventor: James Anthony McCrea, 204 Los Gatos Blvd, Los Gatos, Calif. 95032

[21] Appl. No.: 09/187,008

[22] Filed: Nov. 4, 1998

[51] Int. Cl.[6] ..... E05B 73/00

[52] U.S. Cl. ..... 70/18; 0/58; 0/232; 0/DIG. 57

[58] Field of Search ..... 70/18, 49, 58, 70/232, DIG. 57, 14, 30

[56] References Cited

U.S. PATENT DOCUMENTS

| | | | |
|---|---|---|---|
| 1,520,902 | 12/1924 | Junkunc | 70/18 |
| 2,639,604 | 5/1953 | Wardius | 70/58 |
| 3,101,695 | 8/1963 | Honeyman, Jr. | 70/58 |
| 3,785,183 | 1/1974 | Sander | 70/58 |
| 4,065,946 | 1/1978 | Loynes et al. | 70/DIG. 57 X |
| 4,281,524 | 8/1981 | Linder | 70/DIG. 57 X |
| 4,300,371 | 11/1981 | Herwick et al. | 70/58 |
| 4,340,376 | 7/1982 | Williams | 70/DIG. 57 X |
| 4,546,627 | 10/1985 | Shrawder et al. | 70/18 |
| 4,591,127 | 5/1986 | Tuvesson | 70/18 X |
| 4,869,084 | 9/1989 | Mack, Jr. | 70/18 X |
| 5,035,126 | 7/1991 | Biba | 70/18 |
| 5,279,136 | 1/1994 | Perry | 70/18 |

FOREIGN PATENT DOCUMENTS

| | | | |
|---|---|---|---|
| 726908 | 10/1942 | Germany | 70/18 |
| 3938799 | 5/1991 | Germany | 70/58 |

*Primary Examiner*—Lloyd A. Gall

[57] ABSTRACT

Subject invention is a cable lock designed such that it may be adjusted by the user to be locked tightly around an object such as a surfboard. A sleeve fitting is swaged to a length of cable such that a loop is formed at the end of cable. This loop is used to secure the cable to a rack or other stationary component. A block is used to retain the cable around the object itself. The cable passes through a hole in one end of the block, wraps around the object, and slides into a slot in the other end of the block. An end fitting swaged to the cable prevents the cable from sliding out of the slot in a parallel direction. A padlock is used to prevent the cable from sliding out of the slot in a perpendicular direction. A setscrew is used to retain the block to the cable in the desired location.

1 Claim, 2 Drawing Sheets

ADJUSTABLE CABLE LOCK

BACKGROUND OF INVENTION

This invention is in the field of cable locking devices. It differs from typical cable locks by virtue of its adjustablity. The device may be adjusted by the user to be locked tightly around an object. This ability can be utilized to secure many objects which would be difficult or impossible to secure with unadjustable locking devices. For example, when this device is adjusted and locked tightly around a surfboard just in front of its fin(s), the device cannot be slid forward over the taper of the surfboard or backward over the fins. Because the surfboard does not typically have an opening through which to pass a locking device, it would be difficult to secure this object with an unadjustable locking device.

DESCRIPTION OF THE DRAWINGS

The components and features of the invention can be better appreciated upon consideration of the attache drawings including.

DESCRIPTION OF THE INVENTION

Figure 2:
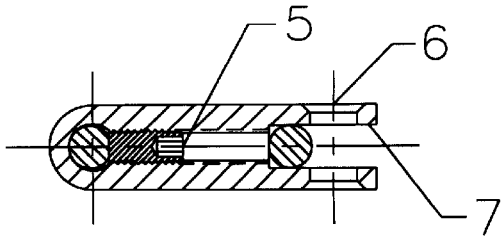
FIG. 2 depicting a sectional view of the device taken along lines 2—2 of FIG. 1.
Figure 1:
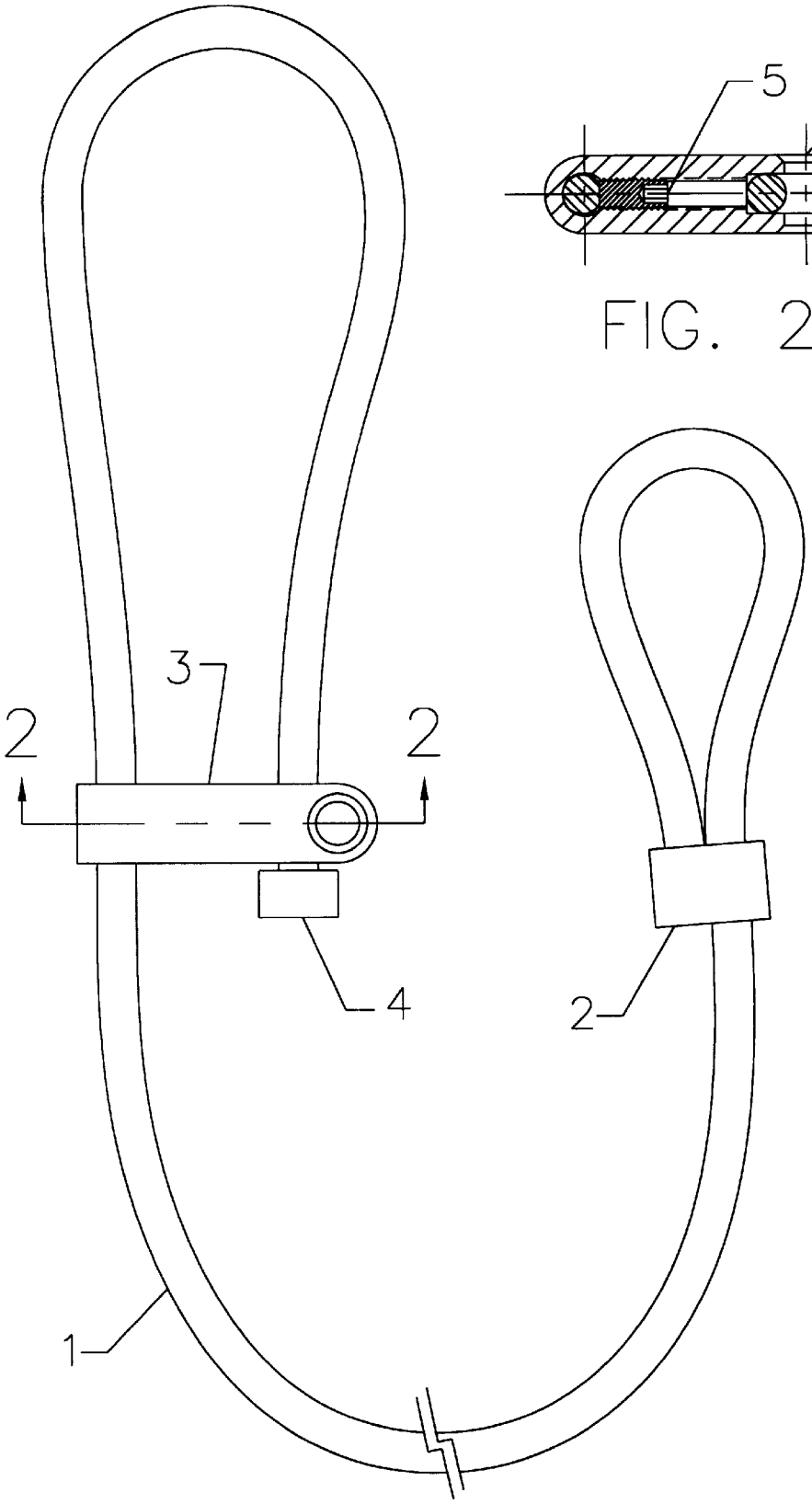
FIG. 1 depicting the locking device.
Figure 3:
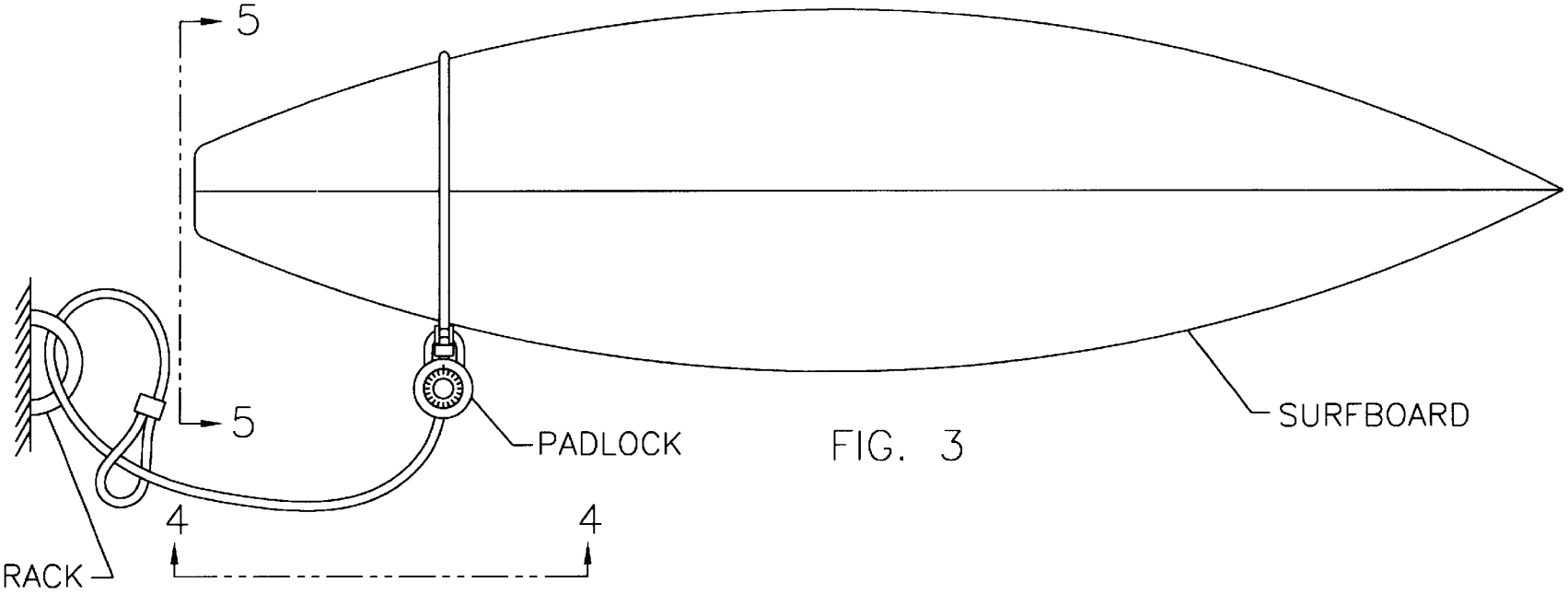
FIG. 3 depicting the locking device installed on a typical surfboard and secured with a typical padlock to a rack.
Figure 5:
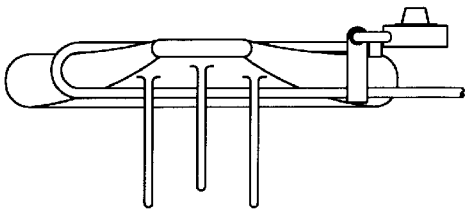
FIG. 5 depicting a partial view taken along lines 5—5 of FIG. 3.
Figure 4:
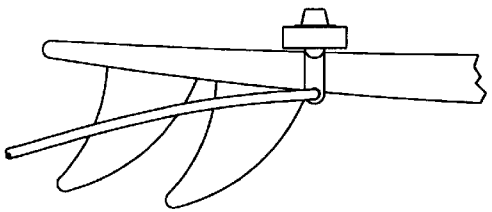
FIG. 4 depicting a partial view taken along lines 4—4 of FIG. 3.

Component 1 is a length of cable.

Component 2 is a sleeve fitting swaged to cable (1) such that a loop is formed at the end.

Component 3 is a block of steel or other suitable material featuring: a hole (6) through which cable (1) passes; a threaded hole perpendicular to the first hole; a slot (7) parallel to the first hole sized for the diameter of cable (1); a hole transverse to the slot sized for a padlock.

Component 4 is an end fitting swaged to cable (1) on the opposite end as sleeve fitting (2) such that block (3) is located on cable (1) between end fitting (4) and sleeve fitting (2).

Component 5 is a setscrew screwed into the threaded hole of block (3) used to retain block (3) on cable (1).

OPERATION OF THE INVENTION

Before use of the locking device, block (3) will first need to be positioned on and secured to cable (1) by way of setscrew (5). In the case of a surfboard, this may be done as follows:

1. Remove setscrew (5) from block (3).
2. Wrap the segment of cable (1) between block (3) and end fitting (4) around the surfboard just in front of the fin(s).
3. Place cable (1) into the slot in block (3) such that end fitting (4) is adjacent to block (3).
4. Place a padlock through the hole perpendicular to the slot in block (3) such that cable (1) is retained.
5. Slide cable (1) through the hole in block (3) until cable (1) is taught around the surfboard.
6. Scribe the position of block (3) on cable (1).
7. Remove the padlock.
8. Remove cable (1) from the slot on block (3).
9. Insuring block (3) is still positioned at the scribed mark on cable (1), screw setscrew (5) into the threaded hole in block (3) such that cable (1) is swaged by setscrew (5) and thus retained to block (3).

The Locking Device is now ready for use. In the case of locking the surfboard to a rack, this may be done as follows:

1. First wrap cable (1) around the rack.
2. Pass end fitting (4) through the loop formed by sleeve fitting (2) on cable (1) and draw cable (1) through the loop until block (3) has passed through the loop.
3. Wrap the segment of cable (1) between block (3) and end fitting (4) around the surfboard just in front of the fin(s).
4. Place cable (1) into the slot in block (3) such that end fitting (4) is adjacent to block (3).
5. Place a padlock through the hole perpendicular to the slot in block (3) and lock in place.

I claim:

1. A device designed to be locked around an object, the device comprising a length of cable, a end fitting swaged to one end of the cable, a block having a hole through which said cable passes such that there is a section of cable between said end fitting and said block, a slot in said block parallel to said hole such that said cable can slide through said slot and said end fitting cannot slide through said slot, a threaded hole in said block between and perpendicular to said hole and said slot, a setscrew screwed into said threaded hole for retaining said block to said cable, a transverse hole through said block such that when the section of cable between said end fitting and said block is placed into said slot a padlock may be places through said transverse hole preventing the radial movement of the cable in said slot and preventing access to said setscrew whereby the user may adjust the length of cable between said end fitting and said block and lock the device in place without special tools or keys.

* * * * *